US005719915A

United States Patent [19]

Koike et al.

[11] Patent Number: 5,719,915

[45] Date of Patent: Feb. 17, 1998

[54] X-RAY DISPERSING/FOCUSING DEVICE AND METHOD OF PRODUCING SAME

[75] Inventors: Masaki Koike; Isao Suzuki, both of Tsukuba, Japan

[73] Assignee: Agency of Industrial Science and Technology, Tokyo, Japan

[21] Appl. No.: 610,545

[22] Filed: Mar. 6, 1996

[30] Foreign Application Priority Data

Mar. 23, 1995 [JP] Japan ..... 7-063670

[51] Int. Cl.[6] ..... H01J 35/00

[52] U.S. Cl. ..... 378/84; 378/85

[58] Field of Search ..... 378/84, 85, 70, 378/82, 36, 43

[56] References Cited

U.S. PATENT DOCUMENTS 2,679,474 5/1954 Pajes ..... 204/27
4,243,398 1/1981 Nomura et al. ..... 65/2

FOREIGN PATENT DOCUMENTS 0055554 7/1982 European Pat. Off. ..... 378/84

OTHER PUBLICATIONS

Richard M. Bionta et al, "Hard X-ray Sputtered-Sliced Phase Zone Plates," *Applied Physics Letters*, vol. 64, No. 8 (Feb. 21, 1994), pp. 945–947.

V.V. Aristov et al, "Bragg Zone Plates for Hard X-ray Focusing," *Nuclear Instruments and Methods in Physics Research*, A261, Nos. 1–2 (Nov. 1, 1987), pp. 72–74.

*Primary Examiner*—David P. Porta
*Attorney, Agent, or Firm*—Spencer & Frank

[57] ABSTRACT

Two kinds of substances are deposited on the surface of a substrate with their thicknesses being gradually decreased according to a Fresnel pattern to form a deposited material. The material is sliced in a direction parallel to the direction of deposition of the two kinds of substance. The slice is fixed as an interference plate on the surface of a dispersing crystal in order to obtain an X-ray dispersing/focusing device. The interference plate fixed on the surface of the dispersing crystal focuses photons by the Fresnel diffraction during the incidence and reflection of X-rays to and from the dispersing crystal, and acts as a dispersing/focusing device as a whole. The dispersing crystal also acts as a base plate supporting the interference plate. Since an interference plate with an outermost zone width of the Fresnel pattern of 1 nm or less is producible, the focusing of X-rays to small regions can be realized.

6 Claims, 6 Drawing Sheets

X-RAY DISPERSING/FOCUSING DEVICE AND METHOD OF PRODUCING SAME

BACKGROUND OF THE INVENTION

1. Field of the Invention

This invention relates to an X-ray dispersing/focusing device preferred for use in measuring instruments and spectroscopic instruments utilizing X-rays, and a method of producing it.

2. Description of the Prior Art

Among devices capable of dispersing and focusing X-rays at the same time is a Bragg-Fresnel device (e.g., V. V. Aristov et al., Nuclear Instruments and Methods in Physics Research A261(1987)72). This device, as shown in FIG. 1 or 2, has a linear or concentric Fresnel pattern 102 formed microlithographically onto the surface of a silicon (111) crystal 101, and thus can perform both the dispersion of X-rays based on Bragg's principle and the focusing of X-rays by the Fresnel diffraction. Each of the projections and depressions of the Fresnel pattern formed by microlithography is called a zone. In FIG. 1, for example, a projecting zone 102*a* is present at the center, and depressed zones 102*b* and projecting zones 102*a* are repeated outwards. FIG. 1 shows an example of a one-dimensional Bragg-Fresnel device with a Fresnel pattern composed of linear zones. FIG. 2 shows an example of a two-dimensional Bragg-Fresnel device with a Fresnel pattern consisting of concentric zones. The zones are designated such that the central projecting zone is called the first zone, and the following depressed zone, the second zone. The final zone is designated as the Nth zone. The distance, $r_n$, between the center and the boundary of the nth zone is expressed by the equation (1):

$$r_n=(nf\lambda)^{1/2}/\sin\theta_B \quad (1)$$

where f is the focal length, λ is the wavelength of X-rays, and $\theta_B$ is the angle of Bragg reflection which is the angle of incidence of X-rays determined by the lattice constant of the crystal used, and the wavelength of X-rays.

An example of a method of producing such a Bragg-Fresnel device is illustrated in FIGS. 3A to 3D. In the step of FIG. 3A, a resist of PMMA or the like is coated onto a silicon (111) substrate 101. The top of the resist is scanned with an electron beam through a Fresnel pattern to cure it. The portion other than the corresponding pattern is washed away to form a Fresnel pattern 102 on the silicon substrate 101. Then, in the step of FIG. 3B, aluminum is deposited to form aluminum layers 103 and 104 on the exposed surface of the substrate 101 and the exposed surface of the Fresnel pattern 102, respectively. In the subsequent step shown in FIG. 3C, the Fresnel pattern 102 and the aluminum layer 104 deposited on the pattern 102 are removed. In the following step shown in FIG. 3D, the portion 101*a* of the substrate 101 which is not protected with the aluminum layer 103 is etched. The depth h to be etched is determined by the following equation such that the phase difference of X-rays reflected at the adjacent zones should be π:

$$h=\lambda\sin\theta_B/\chi_o \quad (2)$$

where, $\chi_o$ is the Fourier component of the polarizability of the crystal.

The resolution power, Δ, for X-rays by the Bragg-Fresnel device is given by $$\Delta=1.22\delta r_N \quad (3)$$

where $\delta r_N$ is the width of the outermost zone ($r_N-r_{N-1}$). The smaller this value, the better the resolution for X-rays to be focused becomes.

For example, detailed parameters for the Bragg-Fresnel device produced by the method described above are, in the case of the one-dimensional Bragg-Fresnel device of FIG. 1, as follows the crystal is silicon (111); a half of the length of the central zone, $r_1$, is 10 μm; the width of the final zone, $\delta r_N$, is 0.5 μm; the focal length, f, is 39 mm; the wavelength of X-rays, λ, is 0.154 nm; and the depth of etching, h, is 2.5 μm. In the case of the two-dimensional Bragg-Fresnel device of FIG. 2, the crystal is silicon (333); the radius of the central zone, $r_1$, is 14 μm; the width of the final zone, $\delta r_N$, is 0.5 μm; the focal length, f, is 940 mm; the wavelength of X-rays, λ, is 0.2085 nm; and the depth of etching, h, is 3.8 μm.

In order to improve the resolution for X-rays in the above-described Bragg-Fresnel device, the width of the final zone, i.e., the outermost zone, $\delta r_N$, must be minimized, as shown in the equation (3). The aspect ratio of the etching depth and the width of the outermost zone, $h/\delta r_N$, is 5 for the one-dimensional Bragg-Fresnel device of FIG. 1, and 7.6 for the two-dimensional Bragg-Fresnel device of FIG. 2. The current lithographic technique faces difficulty in making that ratio large. Furthermore, the depth of etching, h, has to take a high value as the X-ray energy increases, and the device for high-energy X-rays comes to have a degraded resolution.

As noted above, for a conventional X-ray dispersing/focusing device and a conventional method of producing it, it has been difficult to obtain a small width of the outermost zone. They have also posed the problem that the resolution becomes degraded when high energy X-rays are dispersed and focused.

SUMMARY OF THE INVENTION

The object of the present invention is to provide an X-ray dispersing/focusing device and a method of producing it, the device and the method being free from the problems of the conventional device and method.

In order to attain this object, the X-ray dispersing/focusing device of the present invention consists of a dispersing crystal for performing dispersion based on Bragg's principle, and an interference plate fixed on the surface of the dispersing crystal and capable of performing focusing by the Fresnel diffraction, wherein the interference plate consists of two kinds of substances desposited alternately in the width direction with varying thicknesses.

Here, the thicknesses of the two kinds of substances in the interference plate gradually decrease according to a Fresnel pattern, from one end to the other end of the interference plate, or gradually decrease concentrically according to the Fresnel pattern, from the center to the outer edge of the interference plate.

The method of producing the X-ray dispersing/focusing device of the present invention comprises depositing two kinds of substances on a flat plate-like substrate with their thicknesses being gradually decreased according to a Fresnel pattern; slicing the deposited substrate in a direction parallel to the direction of deposition of the two kinds of substances; and fixing the slice as an interference plate on the surface of a dispersing crystal.

Another method of producing the X-ray dispersing/focusing device of the present invention comprises depositing two kinds of substances on the outer peripheral surface of a round bar-like substrate with their thicknesses being gradually decreased according to a Fresnel pattern to form a cylindrical deposited material; slicing this cylindrical material along a plane orthogonal to the central axis of the cylindrical material; and fixing the slice as an interference plate on the surface of a dispersing crystal.

In accordance with the above mentioned product, the interference plate focuses photons by Fresnel diffraction during the incidence and reflection of X-rays to and from the dispersing crystal, and acts as a dispersing/focusing device as a whole. The Fresnel pattern of the interference plate is composed of the two kinds of substances deposited together, and thus does not undergo restrictions as encountered in etching in the conventional method. If the two kinds of substances are deposited by helicon plasma (HP) sputtering, for example, a device with an outermost zone width of 1 nm or less is producible. This can improve the resolution for X-rays, and easily realize the dispersion and focusing of X-rays into small regions that have hitherto been impossible. According to the present invention, moreover, degradation of the resolution for high energy X-rays can be prevented by making the thickness of the interference plate large, namely, by imparting a large thickness to the slice.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The embodiments of the present invention will be described with reference to the appended drawings.

EMBODIMENT 1

Figure 4A:
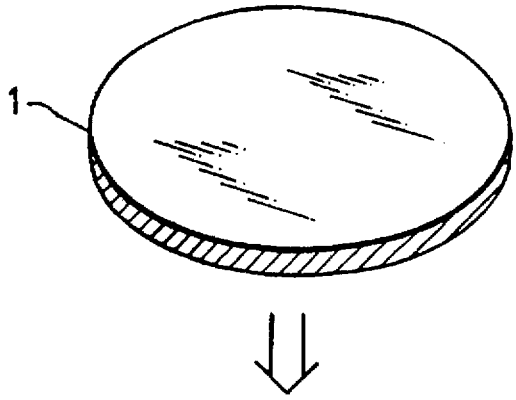
FIGS. 4A to 4C are perspective views illustrating a method of producing a one-dimensional pattern device, a first embodiment of an X-ray dispersing/focusing device according to the present invention.
Figure 4B:
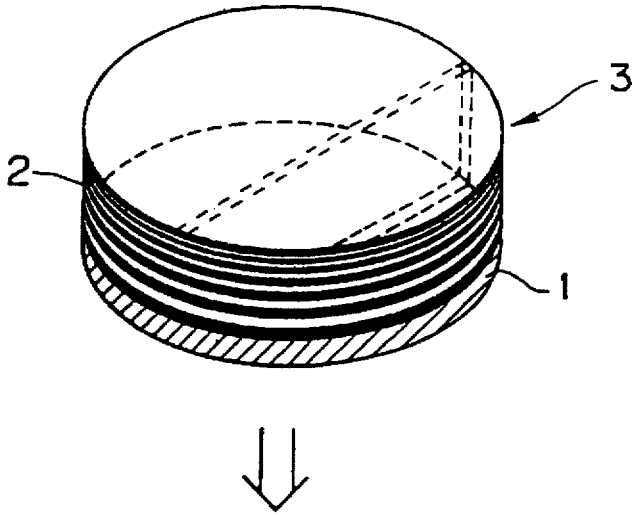
Figure 4C:
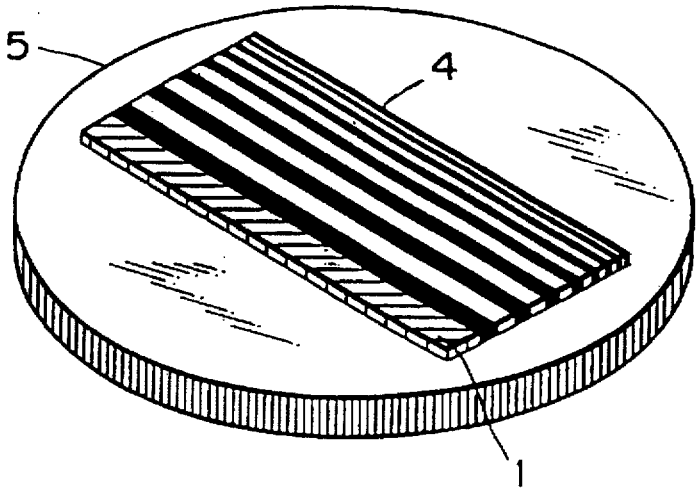

FIGS. 4A to 4C are intended to illustrate the first embodiment of the present invention, showing the respective steps of production of an X-ray dispersing/focusing device with a one-dimensional Fresnel pattern.

As shown in FIG. 4A, a flat plate-like substrate 1 is used as a substrate for forming the one-dimensional pattern device.

In a subsequent step shown in FIG. 4B, two kinds of substances are deposited alternately on the substrate 1 by a technique, such as HP sputtering, with their thicknesses being varied, to form a disk-shaped deposited material 3 having a deposited film arrangement 2 with a section corresponding to a Fresnel pattern. Here, the thickness from the first layer to the nth layer is expressed as:

$$R_n=(r_0^2+nf\lambda/\sin^2\theta_B)^{1/2} \quad (4)$$

where the value of $r_0$ is arbitrary for the one-dimensional pattern device.

As for the combination of the two kinds of substances deposited, an intensity-modulated device can be prepared by using a combination of a heavy element and a light element, or a phase-modulated device can be prepared by using a combination of different light elements. When the intensity-modulated device is to be formed, a material which scarcely absorbs X-rays is selected for the substrate. When the phase-modulated device is to be formed, the same material as the substrate is selected as one of the substances constituting the combination.

After deposition is completed, the material 3 is sliced at a subsequent step in a direction perpendicular to the plane of deposition of the deposited film arrangement 2, namely, in a direction parallel to the direction of deposition, as shown in FIG. 4B. Then, the resulting slice is polished and glued in a final step shown in FIG. 4C in order to obtain an interference plate 4 comprising the two kinds of substances alternately arranged with varying thicknesses. The thickness of this interference plate is, in the case of the intensity-modulated type, such that X-rays are fully absorbed in the heavy element zones in reciprocating motions, and X-rays are not absorbed in large amounts at the light element zones in to-and-fro movements. In the case of the phase-modulated type, its thickness is such that the phase difference of X-rays between two adjacent zones is $\pi$ in reciprocating motions. The interference plate 4 is disposed fixedly on a dispersing crystal 5 in order to create a dispersing/focusing device. The light dispersing crystal 5 also serves as a base plate supporting the interference plate 4.

EMBODIMENT 2

Figure 5A:
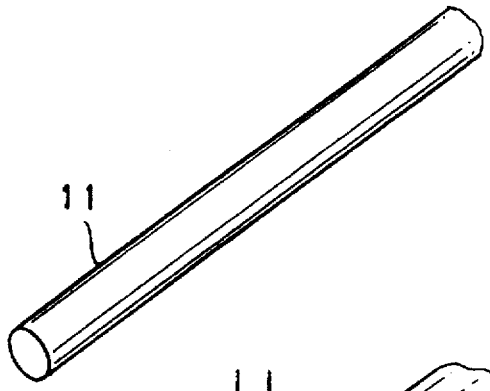
FIGS. 5A to 5C are perspective views illustrating a method of producing a two-dimensional pattern device, a second embodiment of the X-ray dispersing/focusing device according to the present invention.
Figure 5B:
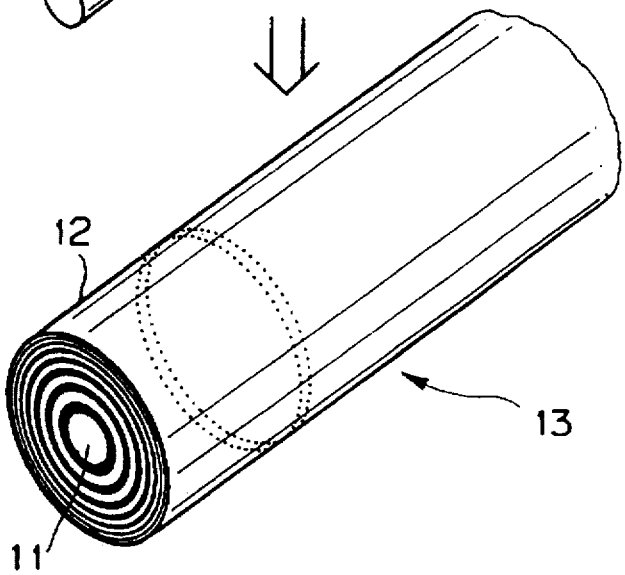
Figure 5C:
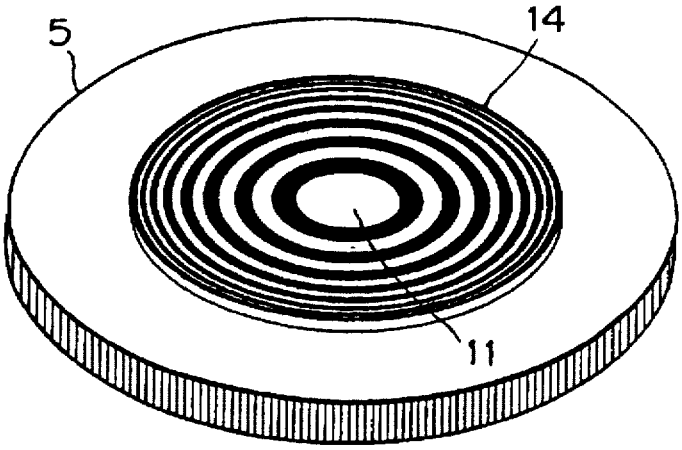

FIGS. 5A to 5C are intended to illustrate the second embodiment of the present invention, showing the respective steps of production of an X-ray dispersing/focusing device with a two-dimensional Fresnel pattern.

As shown in FIG. 5A, a round bar-like substrate 11 is used as a substrate for forming the two-dimensional pattern device.

At a subsequent step shown in FIG. 5B, two kinds of substances are deposited alternately on the substrate 11 by a technique, such as HP sputtering, with their thicknesses being varied, to form a cylindrical material 13 having a deposited film arrangement 12 with a section corresponding to a Fresnel pattern. Here, the thickness from the first layer to the nth layer is expressed as in the equation (4), where the value of $r_0$ in this two-dimensional pattern device is the radius of the round bar-shaped substrate 11.

As for the combination of the two kinds of substances deposited, an intensity-modulated device can be prepared by using a combination of a heavy element and a light element, or a phase-modulated device can be prepared by using a combination of different light elements, as in the case of the device of Embodiment 1. When the intensity-modulated device is to be formed, a material which scarcely absorbs X-rays is selected for the substrate. When the phase-modulated device is to be formed, the same material as for the substrate is selected as one of the substances constituting the combination.

After deposition is completed, the cylindrical material 13 is sliced at a subsequent step in a direction orthogonal to the central axis of the material 13, namely, in a direction parallel to the direction of deposition, as shown in FIG. 5B. Then, the resulting slice is polished and glued in a final step shown in FIG. 5C in order to obtain an interference plate 14 comprising the two kinds of substances alternately arranged with varying thicknesses. The thickness of this interference plate 14 is, in the case of the intensity-modulated type, such that X-rays are fully absorbed in the heavy element zones in reciprocating motions, and X-rays are not absorbed in large amounts at the light element zones in to-and-fro movements. In the case of the phase-modulated type, its thickness is such that the phase difference of X-rays between two adjacent zones is $\pi$ in reciprocating motions. The interference plate 14 is disposed fixedly on a dispersing crystal 5 in order to create a dispersing/focusing device. The dispersing crystal 5 also serves as a base plate supporting the interference plate 14.

Figure 1:
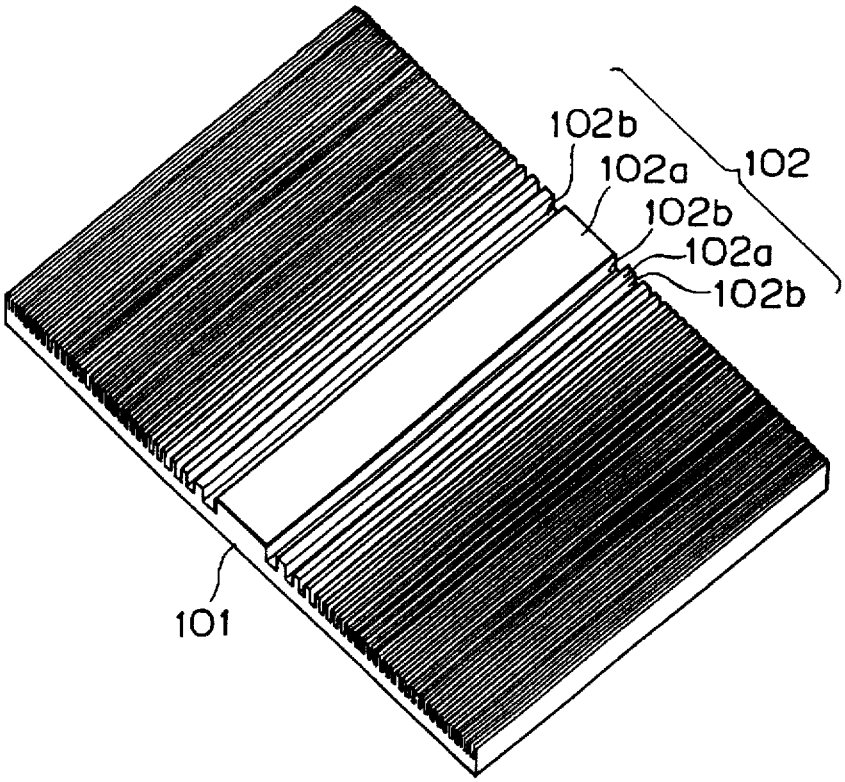
FIG. 1 (PRIOR ART)
FIG. 1 is a schematic view showing a conventional Bragg-Fresnel device with a one-dimensional pattern consisting of the zones of a linear Fresnel pattern.
Figure 2:
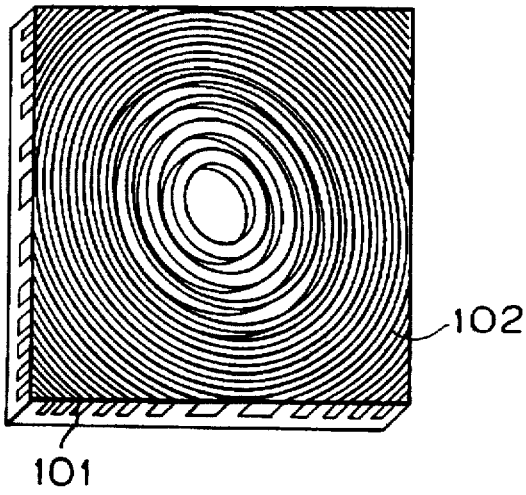
FIG. 2 (PRIOR ART)
FIG. 2 is a schematic view showing a conventional Bragg-Fresnel device with a two-dimensional pattern consisting of the zones of a concentric Fresnel pattern.
Figure 3A:
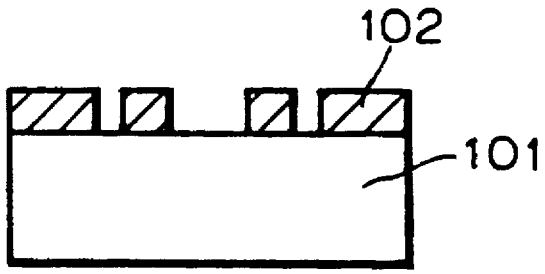
FIGS. 3A to 3D are views explaining an example of a method of producing a conventional Bragg-Fresnel device.
Figure 3B:
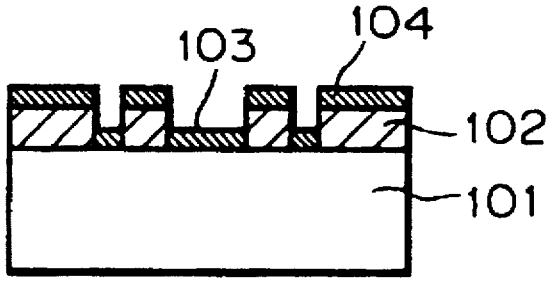
Figure 3C:
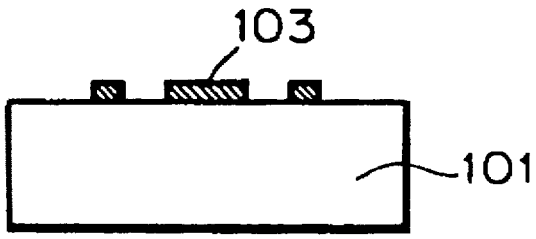
Figure 3D:
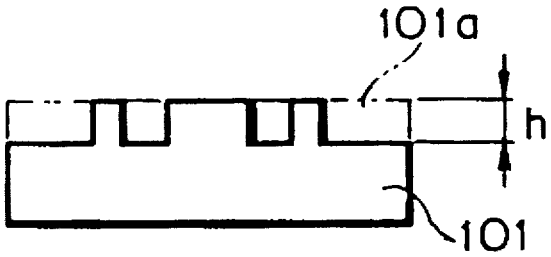
Figure 6:
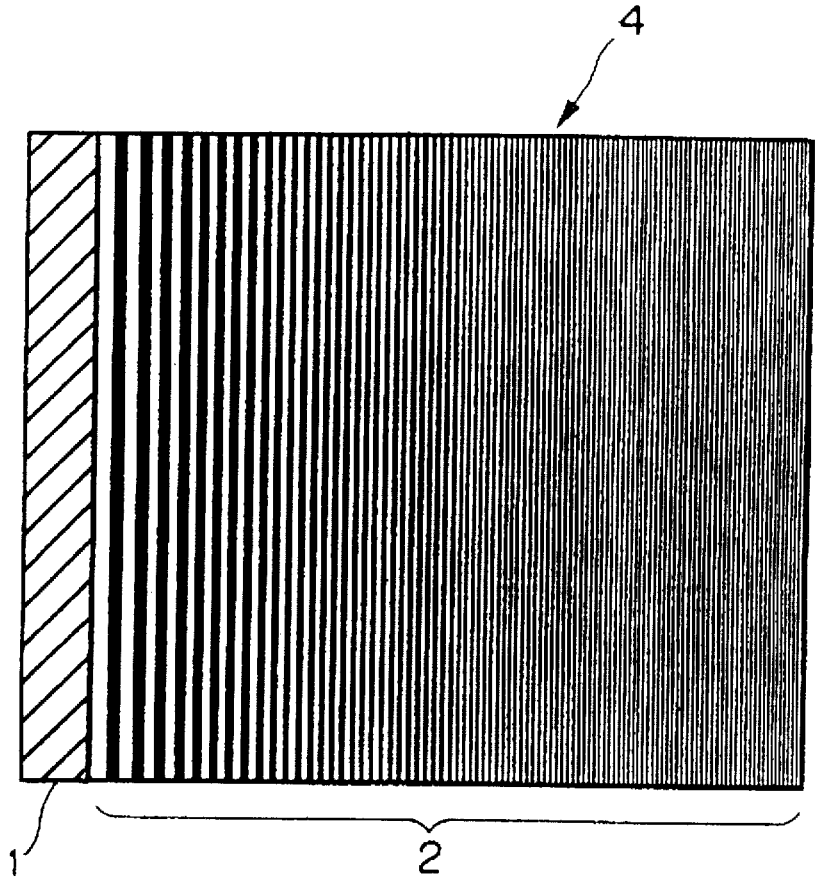
FIG. 6 is a schematic view of a scanning electron micrograph of the interference plate of an intensity-modulated X-ray dispersing/focusing device according to the present invention produced by HP sputtering.

FIG. 6 is a scanning electron micrograph of the interference plate 4 of the intensity-modulated Bragg-Fresnel device of Embodiment 1 produced by the HP sputtering. The left end of FIG. 6 represents the silicon substrate 1 (cross-hatched in the drawing). The deposited film arrangement 2 on the silicon substrate 1 comprises 100 pairs of layers of silver as the heavy element (white in the drawing) and aluminum as the light element (black in the drawing) deposited alternately according to the equation (4), constituting a total of 200 layers. The interference plate 4 in sliced form is fixed on a germanium (422) crystal (as the dispersing crystal 5) in order to obtain an intensity-modulated Bragg-Fresnel device. The width of the outermost zone, $\delta r_N$, of the interference plate 4 of FIG. 6 is 75 nm, a value which is 3/20 of the corresponding width of the conventional type shown in FIG. 1 or 2. The HP sputtering technique can yield an interference plate with the thickness of each layer of the deposited film arrangement being 1 nm or less (Koike et al., International Conference on Synchrotron Radiation Instrumentation, New York (1994)). Thus, the resulting dispersing/focusing device can be expected to exhibit markedly improved performance. For X-rays with high energy, the dispersing/focusing device of the present invention can be produced more easily, since it is not necessary to thin the deposited material to a small thickness.

Figure 7:
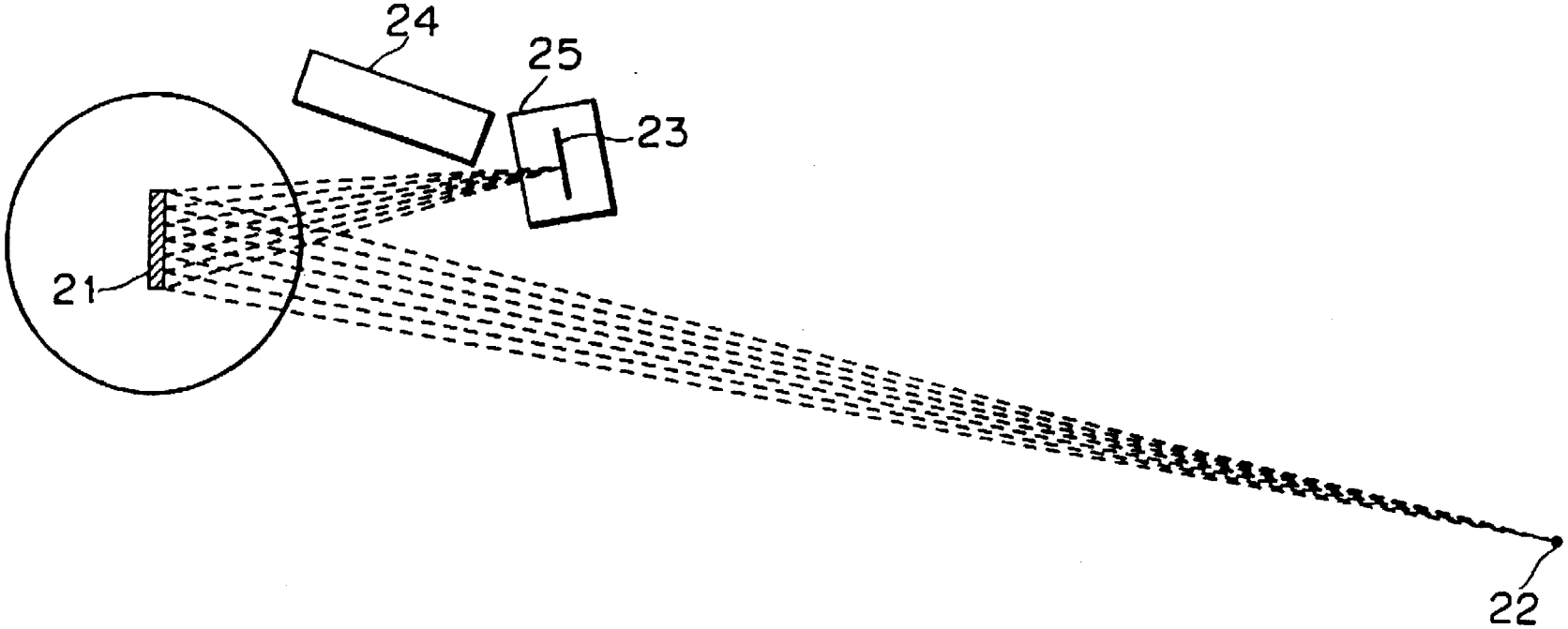
FIG. 7 is an abridged structural view showing an example of a scanning X-ray microscope incorporating the X-ray dispersing/focusing device of the present invention.

FIG. 7 is a schematic view showing an example of a scanning X-ray microscope using the X-ray dispersing/focusing device of the present invention. In FIG. 7, the numeral 21 signifies an X-ray dispersing/focusing device according to the present invention, 22 an X-ray source, 23 a sample, 24 a detector, and 25 an X-Y stage bearing the sample 23. The X-ray source 22 may be an X-ray tube source, a synchrotron radiation X-ray source, or a laser plasma X-ray source. X-rays from the X-ray source 22 are monochromatized by the X-ray dispersing/focusing device 21, and focused onto the position of the sample 23. The small regions of the sample 23 excited by the focused X-rays generate fluorescent X-rays having energies corresponding to the constituent elements of the small regions. The fluorescent X-rays are detected by the detector 24 for analysis, whereby the constituent elements of those regions can be known quantitatively. Such detection and analysis are repeated with the position of the sample 23 being varied step by step by means of the X-Y stage 25. This gives information of the quantitative distribution of those constituent elements in the sample 23.

The present invention has been described in detail with respect to preferred embodiments, and it will now be clear that changes and modifications may be made without departing from the invention in its broader aspects, and it is our intention, therefore, in the appended claims to cover all such changes and modifications as fall within the true spirit of the invention.

What is claimed is:

1. An X-ray dispersing/focusing device comprising;

a dispersing crystal for performing light dispersion based on Bragg's principle, and an interference plate disposed in a fixed manner on the surface of the dispersing crystal and capable of performing focusing by the Fresnel diffraction, wherein the interference plate comprises two kinds of substances deposited alternately in the width direction with varying thicknesses.

2. The X-ray dispersing/focusing device as claimed in claim 1, wherein the changes in the thicknesses of the two kinds of substances in the interference plate are such that the thicknesses gradually decrease according to a Fresnel pattern, from one end to the other end of the interference plate.

3. The X-ray dispersing/focusing device as claimed in claim 1, wherein the changes in the thicknesses of the two kinds of substances in the interference plate are such that the thicknesses gradually decrease concentrically according to the Fresnel pattern, from the center to the outer edge of the interference plate.

4. The X-ray dispersing/focusing device of claim 1, wherein the dispersing/focusing device has a front side and a back side and wherein the interference plate is disposed at the front side of the dispersing/focusing device, in combination with means for exposing the front side of the dispensing/focusing device to X-rays and means for supporting an object before the front side of the dispersing/focusing device to receive X-rays focused on the object by the interference plate.

5. A method of producing an X-ray dispersing/focusing device, which comprises;

depositing two kinds of substances on the outer peripheral surface of a round bar-like substrate with their thicknesses being gradually decreased according to a Fresnel pattern to form a cylindrical deposited material, slicing the cylindrical deposited material along a plane orthogonal to the central axis of the cylindrical deposited material, and fixing the slice as an interference plate on the surface of a dispersing crystal.

6. A method of producing an X-ray dispersing/focusing device, which comprises;

depositing two kinds of substances on a flat plate-like substrate with their thicknesses being gradually decreased according to a Fresnel pattern to form a plate-like deposited material, slicing the deposited material in a direction parallel to the direction of deposition of the two kinds of substances, and fixing the slice as an interference plate on the surface of a dispersing crystal.

* * * * *